US009340318B2

(12) United States Patent
Nomoto et al.

(10) Patent No.: US 9,340,318 B2
(45) Date of Patent: May 17, 2016

(54) OBJECT-HOLDING SHEET, TEST METHOD AND OBJECT-TREATING EQUIPMENT

(75) Inventors: Tsuyoshi Nomoto, Tokyo (JP); Kohei Watanabe, Yokohama (JP); Takeshi Miyazaki, Yokohama (JP); Toshio Tanaka, Tsu (JP); Yasuhito Shimada, Nagoya (JP)

(73) Assignee: Canon Kabushiki Kaisha, Tokyo (JP)

( * ) Notice: Subject to any disclaimer, the term of this patent is extended or adjusted under 35 U.S.C. 154(b) by 402 days.

(21) Appl. No.: 12/788,168

(22) Filed: May 26, 2010

(65) Prior Publication Data

US 2010/0300547 A1 Dec. 2, 2010

(30) Foreign Application Priority Data

May 29, 2009 (JP) ..... 2009-131621

(51) Int. Cl.
*B01L 3/00* (2006.01)
*B65D 19/00* (2006.01)

(52) U.S. Cl.
CPC ..... *B65D 19/002* (2013.01); *Y10T 137/0318* (2015.04)

(58) Field of Classification Search
CPC ..... B01L 2300/0609; B01L 2200/025
USPC ..... 422/551, 552
See application file for complete search history.

(56) References Cited

U.S. PATENT DOCUMENTS 4,894,343 A * 1/1990 Tanaka et al. ..... 435/285.2
5,324,483 A * 6/1994 Cody et al. ..... 506/40
6,315,957 B1 * 11/2001 Feygin ..... B01L 3/50255 422/534
2007/0264705 A1 11/2007 Dodgson

FOREIGN PATENT DOCUMENTS

EP 1330306 A2 7/2003
JP 60129174 A 7/1985
JP 2004066110 A 3/2004
JP 2004510996 A 4/2004
JP 2006075761 A * 3/2006

* cited by examiner

*Primary Examiner* — Natalia Levkovich
(74) *Attorney, Agent, or Firm* — Canon USA Inc. IP Division

(57) ABSTRACT

It is intended to provide an object-holding sheet and an object-treating equipment, which are useful for arranging objects such as biological materials (e.g., cells, embryos or individuals) or particles having the similar size thereto and efficiently conducting procedures such as analysis and fractionation on the objects. The present invention provides an object-holding sheet for holding two or more objects, the object-holding sheet including: a sheet member having two or more through-holes; and an anti-drop member corresponding to each of the holes, wherein the holes have a size that enables only one of the objects to be held, and the anti-drop member is disposed in the vicinity of one opening of each of the holes so as not to permit the object held in each of the holes to pass through the opening.

5 Claims, 7 Drawing Sheets

OBJECT-HOLDING SHEET, TEST METHOD AND OBJECT-TREATING EQUIPMENT

BACKGROUND OF THE INVENTION

1. Field of the Invention

The present invention relates to an object-holding sheet which is useful for arranging objects such as biological materials (e.g., cells, embryos or individuals) or particles having the similar size thereto and efficiently conducting procedures such as analysis and fractionation on the objects. The present invention also relates to a test method and an object-treating equipment using the same.

2. Description of the Related Art

In the field of drug development or disease diagnosis, large-scale and rapid bioassay systems have been demanded, which reliably evaluate chemical substances or biologically active substances for their influences with high throughputs.

For large-scale and rapid treating using the bioassay systems, very small biological materials (e.g., cells or embryos) must be arranged at determined positions, and predetermined procedures such as administration of predetermined substances, liquid exchange, measurement and fractionation must be conducted efficiently on the biological materials.

Heretofore, bioassay systems have been known, in which biological materials (e.g., cells, embryos or individuals) are individually arranged in isolation in the wells of a micro-well plate by, for example, pipetting. In general, the biological materials (e.g., cells or embryos) are very small and fragile and must therefore be handled carefully and accurately.

This procedure requires experience and skills. For example, since embryos during development grow in a short time, they have to be treated in an exceedingly short time. Therefore, there are limitations to the rapid arrangement of large amounts of biological samples using a micro-well plate.

Bioassay systems using a micro-fluidic channel are known as those independent of a micro-well plate. Japanese Patent Application No. 2007-504816 discloses a method for holding biological materials (e.g., cells, embryos or individuals) by means of wells or constrictions provided in a channel. Alternatively, Japanese Patent Application No. 2004-510996 discloses an example of holding microspheres in an array with tapered through-holes.

However, the conventional techniques described in these patent documents had the problem that efficient liquid exchange cannot be achieved because the held object blocks the passage of the liquid in the channel.

SUMMARY OF THE INVENTION

An object of the present invention is to provide an object-holding sheet which permits efficient liquid exchange, and to provide a test method and a treatment equipment using the same.

An object-holding sheet according to the present invention is an object-holding sheet for holding two or more objects, the object-holding sheet including: a sheet member having two or more through-holes; and an anti-drop member corresponding to each of the holes, wherein the holes have a size that enables only one of the objects to be held, and the anti-drop member is disposed in the vicinity of one opening of each of the holes so as not to permit the object held in each of the holes to pass through the opening.

The present invention also provides an object-treating method using the object-holding sheet of the present invention, the method including: allowing one object to be held, together with a liquid, in each of the through-holes; administering a substance to the object; and discharging an excess liquid from the opening on the side provided with the anti-drop member, while supplying a liquid from the other opening of the through-holes.

The present invention further provides an object-treating equipment which includes: a holding unit which holds the object-holding sheet of the present invention; an applying unit for applying a droplet to the through-holes in the object-holding sheet; and a discharging unit which discharges an excess liquid from the opening on the side provided with the anti-drop member, wherein the treatment equipment further includes at least one of the following units (A) to (E): an arranging unit (unit (A)) for arranging an object to each of the through-holes in the sheet member; a controlling unit (unit (B)) for controlling an environment surrounding the object-holding sheet to a predetermined environment; an observing unit (unit (C)) for observing the state of the object held in each of the through-holes in the object-holding sheet; a transporting unit (unit (D)) for transporting, from the object-holding sheet, the object held in each of the through-holes in the object-holding sheet; and a recognizing unit (unit (E)) for recognizing the positions of the through-holes in the object-holding sheet.

Another aspect of the present invention provides an object-holding sheet for holding two or more objects, the object-holding sheet including: a sheet member having two or more through-holes; and an anti-drop member corresponding to each of the holes, wherein the anti-drop member is a linear member, and the linear member is disposed such that a portion thereof partially occupies the central part of one opening of each of the holes.

According to the present invention, owing to the through-holes, a liquid can be exchanged easily without being blocked, while objects can be collected or replaced efficiently. A test method or a treatment equipment using the object-holding sheet of the present invention enables a large number of biological materials (e.g., cells, embryos or individuals) or particles having the similar size thereto to be arranged conveniently and individually and to be tested, analyzed and fractionated efficiently.

Further features of the present invention will become apparent from the following description of exemplary embodiments with reference to the attached drawings.

DESCRIPTION OF THE EMBODIMENTS

Figure 1A:
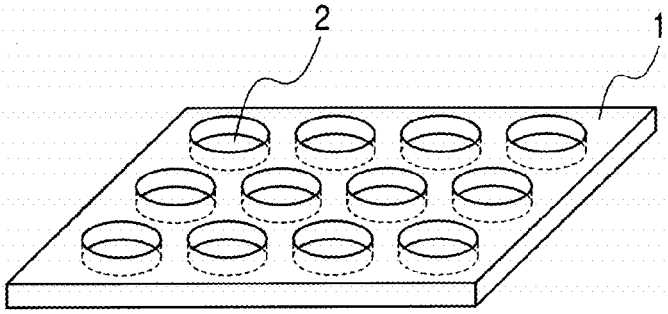
FIGS. 1A, 1B, 1C and 1D are respectively a diagram illustrating an object-holding sheet of the present invention.

Preferred embodiments of the present invention will now be described in detail in accordance with the accompanying drawings.

The embodiments individually disclosed herein are examples of an object-holding sheet, a test method and an object-treating equipment of the present invention and the present invention is not limited thereto.

The present invention provides an object-holding sheet for holding two or more objects, the object-holding sheet including: a sheet member having two or more through-holes; and an anti-drop member corresponding to each of the holes. The feature thereof is that the holes have a size that enables only one of the objects to be held, and the anti-drop member is disposed in the vicinity of one opening of each of the holes so as not to permit the object held in each of the holes to pass through the opening.

The "object" described in the present invention encompasses biological materials (e.g., cells, embryos or individuals) or particles having the similar size thereto.

The biological materials encompass eggs, embryonic individuals, posthatch individuals, and individuals grown from embryos. The individuals encompass the whole process of vertebrates from fertilized eggs to adults. The embryos refer to individuals at a stage from fertilization of eggs to hatching. Accordingly, the embryonic individuals can be eggs (fertilized eggs). The individuals grown from embryos encompass, for example, individuals during advanced embryonic development from fertilized egg state to hatching and further, individuals hatched from fertilized eggs, for example, individuals in a fry (regarded to have features of an adult individuals) state for fishes or in a larval state for amphibians.

In addition to small animals such as rats and mice, larger animals such as pigs, dogs, monkeys and humans may be used as vertebrates. The vertebrates can be amphibians or fishes, which are prolific. Fishes that are as small and prolific as possible can be used in terms of maintenance of test facilities. Particularly, those having a transparent embryo can be used. Fishes whose genomic sequence has been determined or will be determined in the near future can be used for comparing a chemical substance between its influence on the fishes as individuals and its influence on humans. Examples of such amphibians and fishes that can be used particularly can include *Xenopus laevis, Takifugu rubripes, Oryzias latipes* and *Danio rerio*.

Any particle having the similar size to that of the biological materials (e.g., cells, embryos or individuals) can be used without particular limitations. The particles can have a size between 1 μm and 10 mm inclusive.

Examples of a material for the particles include organic polymer substances and inorganic substances. Examples of the organic polymer substances include acrylic acid polymers, styrene polymers and methacrylic acid polymers. Examples of the inorganic substances include silica, alumina and magnetic iron oxide.

The material for the particles is not particularly limited in its color and can be a material that suppresses light reflection in terms of microscopic observation or can be an autofluorescence-free material in terms of fluorescent microscopic observation. The particles may carry an additional functional molecule on their surfaces according to test purposes. Examples of such a functional molecule include antibodies, antigens, nucleic acids, aptamers, sugar chains and enzymes.

First Embodiment

Figure 1B:
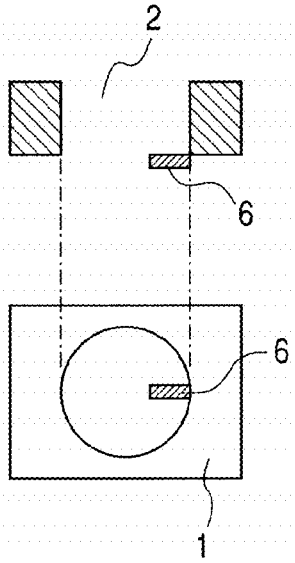

The first embodiment of the object-holding sheet of the present invention includes: a sheet member 1 having two or more through-holes 2; and at least one anti-drop member 6 in each of the holes 2, as seen from the perspective view of FIG. 1A and the cross-sectional view and the plane view of FIG. 1B.

Figures 2A, 2B, 2C:
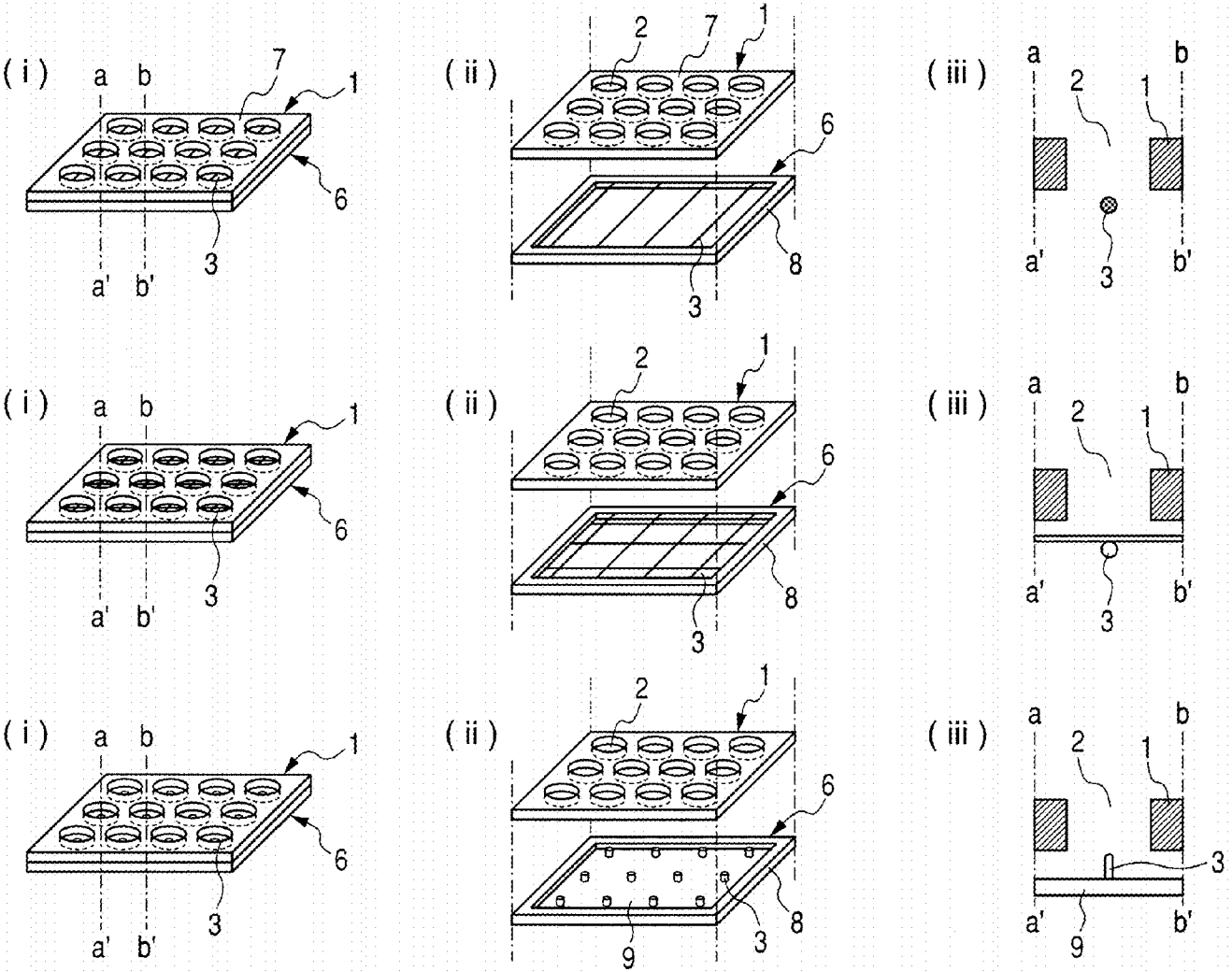
FIGS. 2A, 2B and 2C are respectively a diagram illustrating an object-holding sheet of the present invention having a removable anti-drop member.

As illustrated in FIGS. 2A to 2C, the sheet member 1 has a plurality of (two or more) through-holes (openings) 2 in a base (substrate) 7. Any material in which the holes 2 can be formed can be used for the base 7. Examples of the material that can be used include: metals such as iron, copper and aluminum, or alloys containing these metals; ceramics such as glass, alumina and silicon; plastic resins such as Teflon (registered trademark), polyethylene, polypropylene, polyester, polyacetal, silicon rubbers, polycarbonate, polyvinyl chloride, polystyrene and nylon; and composite materials thereof. However, the base can basically be made of a material that is neither dissolved in water nor elutes its ingredients by water. The holes 2 in the object-holding sheet of the present invention can have a hydrophilized or rough-surfaced inner wall so as to easily hold a liquid. A material for the surface of the sheet member 1 is not particularly limited in its color and can be a material that suppresses light reflection in terms of microscopic observation or can be an autofluorescence-free material in terms of fluorescent microscopic observation.

In the present invention, the holes have a size that enables only one of the objects to be held. This means that each hole 2 has a size that enables one of the objects to be held but does not permit two of the objects to be held. For efficiently and stably holding one object in each hole 2, the hole 2 must have an appropriate aperture area and an appropriate thickness, compared with the size of the object.

In the present invention, the phrase "holding the object" refers to holding the object together with a liquid. Presumably, the liquid is held by interaction with (adhesion to) the inner wall of each hole 2 in the sheet member 1, and the object is wrapped in the liquid and held in this state by the surface tension of the liquid, without dropping off the through-hole 2 having no bottom. Accordingly, under the circumstances where the object-holding sheet of the present invention includes objects and their surrounding liquids, each hole 2 can hold one object together with the liquid held therein but cannot hold two or more objects, owing to the size of the hole.

The aperture area of each hole 2 can range from 1.05 times to 2.63 times the maximum cross-sectional area of the object held therein. For stably holding one object in each hole 2 with higher probability, each hole 2 can particularly have an aperture area ranging from 1.2 to 2.25 times the maximum cross-sectional area of the object. The maximum cross-sectional area of the object refers to the area of a section passing through the center of gravity of, for example, a sphere or almost sphere, such as eggs. Alternatively, when the object is fry or amphibian larva, the maximum cross-sectional area refers to the transverse (horizontal)-sectional area of the fry or the like that can be held in a stable position in the hole 2 together with the liquid. The object-holding sheet of the present invention can usually be kept horizontally in holding the objects.

The size that does not permit two or more objects to be held refers to a size that does not permit the maximum sections of two objects to be geometrically arranged at least relative to the hole 2. In a hole 2 having an aperture area less than 1.05 times the maximum cross-sectional area of the object, the object is hardly arranged together with the liquid. Alternatively, in a hole 2 having an aperture area exceeding 2.63 times the maximum cross-sectional area of the object, a plurality of objects is often arranged together with the liquid. A plurality of holes 2 differing in aperture area may be provided in one base 7.

The base 7 is not particularly required to have a uniform thickness. However, its thickness in the vicinity of the hole 2 can be 0.2 times to 1.9 times the maximum thickness of each object held therein for the purpose of arranging only one object in each hole 2. The maximum thickness of the object refers to the diameter of the maximum cross-sectional area of, for example, a sphere or almost sphere, such as eggs. Alternatively, when the object is fry or amphibian larva, the maximum thickness refers to the thickness in the longitudinal direction of the fry or the like that can be held in a stable position in the hole 2 together with the liquid.

For example, each hole 2 can have a thickness ranging from 0.2 to 1.9 mm for holding an fertilized egg of approximately 1 mm in diameter. A hole 2 having a thickness less than 0.2 times the maximum thickness (or diameter for a sphere) of the object cannot stably hold the object because the liquid is held therein in a small amount relative to the object. As a result, an increasing rate of objects drops off the holes when arranged. Alternatively, a hole 2 having a thickness exceeding 1.9 times the maximum thickness (or diameter for a sphere) of the object holds a plurality of objects with increasing probability.

The holes 2 may have any shape such as polygonal (e.g., quadrangular), elliptical and star shapes, in addition to a circular shape illustrated in FIGS. 1A to 1D, as long as the holes 2 have an aperture area that permits one object to be held efficiently and stably in each hole 2 together with the liquid.

The object-holding sheet of the present invention has a plurality of through-holes 2 in the base 7. The through-holes 2 may be disposed in any region of the base 7 and can be arranged regularly in terms of tests or automated treating for objects described later. Moreover, the number and density of the holes 2 arranged in one base are not limited by any means. From an operational standpoint, holes 2 of approximately 1 mm in diameter can be arranged at a density ranging from 10 holes/$cm^2$ to 100 holes/$cm^2$. Specifically, at a density less than 10 holes/$cm^2$, the base has a wide area other than the holes, and a water droplet tends to remain in isolation in this region. Thus, the object is arranged, together with the water droplet, in the region other than the holes 2, resulting in reduced arrangement efficiency. Alternatively, at a density exceeding 100 holes/$cm^2$, the contamination problem in such a way that the liquid holding the object is mixed with that held in its adjacent hole tends to occur in subsequent treating, due to insufficient distance between the holes 2. Specifically, the ratio between the area of the object-holding sheet of the present invention and the areas of the holes 2 (aperture ratio) can fall within the range of 7.9% to 78.5%.

In the object-holding sheet of the present invention, only one object is held in each of a plurality of holes 2. However, not all of the holes 2 are necessarily required to hold the object. However, as the rate of holes 2 holding the object is extremely reduced, the efficiency of subsequent tests for the object is reduced.

As seen from the cross-sectional view (FIG. 1B), the anti-drop member 6 is disposed in the vicinity of one opening (on the bottom side) of each of the holes 2 so as not to permit the object held in each of the holes 2 to pass through the opening. In this context, the term "passing" means that the held object goes through the space between the opening and the anti-drop member 6.

Figure 1C:
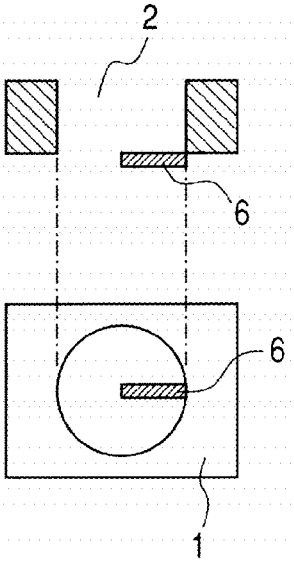
Figure 1D:
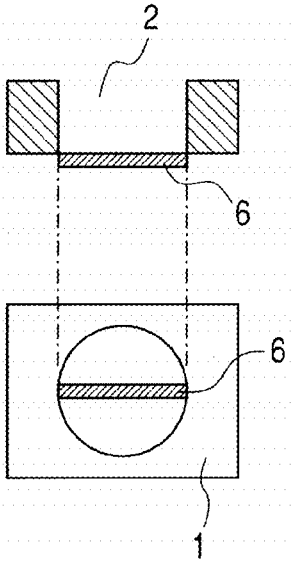

The anti-drop member 6 may be a linear member such as wires. In such a case, the linear member can be disposed such that a portion thereof (anti-drop site) partially occupies the central part of one opening of each of the holes. Specifically, as illustrated in FIG. 1C or 1D, in the opening provided with the anti-drop member 6 in each hole 2, the linear member is disposed such that anti-drop site thereof at least partially occupies the central part containing the center. The central part is defined as a region within 20% of a distance from the center to the circumference. The phrase "at least partially" can mean that a portion of the linear member occupies 10% or more and 100% or less of the region in terms of its area.

The anti-drop member 6 is not particularly limited in its size (length, thickness and width) as long as the size of anti-drop site thereof does not permit the object to pass through the opening provided with the anti-drop member 6. Examples of the length of the anti-drop site of the anti-drop member 6 include a length that is ⅓, ½ or equal to the diameter of the opening, as illustrated in FIGS. 1B, 1C and 1D.

In this embodiment, the anti-drop member 6 is not limited in its formation method. The anti-drop member 6 may be formed by penetration simultaneously with formation of the hole 2 or may be formed by addition to one opening after formation of the through-hole 2. For example, the material and color of the anti-drop member 6 can be the same as those of the base 7.

The sheet member 1 may have a nonconductive surface, and the holes 2 may have a conductive inner wall for individual conduction with the outside. This enables the electric property of the liquid held in each hole 2 to be measured or enables the electrochemical reaction thereof to be measured or induced. The conduction of the conductive inner wall with the outside may be achieved, for example, by carrying out wiring on the surface of the sheet member 1 using conductive ink. An insulating film can further be provided on the wiring to protect the wiring from a short circuit associated with liquid holding. The conductive site in the inner wall of each hole 2 can be divided into two parts, or the anti-drop member 6 can be rendered conductive. As a result, one of these two parts or one of the hole 2 and the anti-drop member 6 can be used as a work electrode, and the other region can be used as a counter electrode.

When the anti-drop member 6 is used as a work electrode or counter electrode, its individual conduction with the outside is performed, for example, by carrying out wiring on the underside of the sheet member 1 using conductive ink.

Second Embodiment

The second embodiment of the object-holding sheet of the present invention is an object-holding sheet having a removable anti-drop member 6, in contrast to the first embodiment having the anti-drop member 6 integrally (irremovably) formed in the sheet member 1. Specifically, as illustrated in (ii) of FIGS. 2A to 2C, the second embodiment includes a frame member 8 removable from a sheet member 1 and a plurality of anti-drop sites 3 mounted to the frame member 8.

Any material to which the anti-drop sites 3 can be mounted can be used for the frame member 8. Examples of the material that can be used include: metals such as iron, copper and aluminum, or alloys containing these metals; ceramics such as glass, alumina and silicon; plastic resins such as Teflon (registered trademark), polyethylene, polypropylene, polyester, polyacetal, silicon rubbers, polycarbonate, polyvinyl chloride, polystyrene and nylon; and composite materials thereof. However, the frame member can basically be made of a material that is neither dissolved in water nor elutes its ingredients by water. The material for the frame member 8 can have rigidity to prevent its shape from being deformed after mounting of the anti-drop sites 3.

The anti-drop sites 3 are in a linear, mesh-like or pin-like form. A plurality of anti-drop sites 3 is provided on the frame member 8. (i) of FIG. 2A is a perspective view schematically illustrating one example of the object-holding sheet having linear anti-drop sites 3. (ii) of FIG. 2A is a perspective view schematically illustrating the object-holding sheet in a state where the anti-drop member 6 including the frame member 8 and the linear anti-drop sites 3 has been removed from the sheet member 1. (iii) of FIG. 2A is a cross-sectional view illustrating the positional relationship of the hole 2 with the linear anti-drop site 3 in the object-holding sheet having the linear anti-drop sites 3.

Moreover, (i) of FIG. 2B is a perspective view schematically illustrating one example of the object-holding sheet having mesh-like anti-drop sites 3. (ii) of FIG. 2B is a perspective view schematically illustrating the object-holding sheet in a state where the anti-drop member 6 including the frame member 8 and the mesh-like anti-drop sites 3 has been removed from the sheet member 1. (iii) of FIG. 2B is a cross-sectional view illustrating the positional relationship of the hole 2 with the mesh-like anti-drop site 3 in the object-holding sheet having the mesh-like anti-drop sites 3.

Furthermore, (i) of FIG. 2C is a perspective view schematically illustrating one example of the object-holding sheet having pin-like anti-drop sites 3. (ii) of FIG. 2C is a perspective view schematically illustrating the object-holding sheet in a state where the anti-drop member 6 including the frame member 8 having a water-absorptive/permeable member 9 and the pin-like anti-drop sites 3 has been removed from the sheet member 1. (iii) of FIG. 2C is a cross-sectional view illustrating the positional relationship of the hole 2 with the pin-like anti-drop site 3 in the object-holding sheet having the pin-like anti-drop sites 3.

In this context, the water-absorptive/permeable member 9 is illustrated as a member supporting the pin-like anti-drop sites 3 for the sake of convenience. However, the pin-like anti-drop sites 3, when used, do not necessarily require a support such as the water-absorptive/permeable member 9. Examples of such pin-like anti-drop sites 3 free from the support include pin-like anti-drop sites 3 formed by the tips of toothpicks that are spaced uniformly from the central part of each hole 2 and bundled in the frame member 8, as described later in Example 2.

When the anti-drop sites 3 are in a linear, mesh-like or pin-like form, each anti-drop site 3 can be positioned at a distance as large as possible from one opening of the hole 2 within a range that does not permit the held object to pass therethrough. In this context, the distance from the opening is defined as follows using the length of a line segment connecting the edge of the opening and the anti-drop site. When the edge of the opening is defined as a closed curve, a set of line segments connecting each point on this curve and the anti-drop site at the shortest distance can be assumed. Of these line segments, the length of a line segment having the largest length is defined as the "maximum value of the distance", and the length of a line segment having the smallest length is defined as the "minimum value of the distance". Moreover, when a portion other than the shadow of the anti-drop site projected from the opening has the largest area, the area of this portion is defined as an "aperture area".

Then, the size of the held object is defined as follows. Arbitrary straight lines crossing the held object are assumed. Of these straight lines, a straight line that gives the largest line segment sectioned by the periphery of the object is defined as the "major axis of the object". The area of the shadow of the object projected in the major axis direction is defined as the "projected area of the object". Furthermore, arbitrary straight lines intersecting the major axis of the object are assumed. Of these straight lines, a straight line that gives the largest line segment sectioned by the periphery of the object is defined as the "thickness of the object".

The range that does not permit the held object to pass therethrough means that, for the linear or pin-like anti-drop sites, the "maximum value of the distance" is smaller than the "thickness of the object". Alternatively, the range that does not permit the held object to pass therethrough means that, for the mesh-like anti-drop sites, the "maximum value of the distance" is smaller than the "thickness of the object" and the "aperture area" is smaller than the "projected area of the object".

The "minimum value of the distance" can be as large as possible within the range that does not permit the held object to pass therethrough. For example, the "minimum value of the distance" can range from 0.1 times to 0.95 times the "thickness of the object". Linear or mesh-like anti-drop sites 3 positioned too close to the sheet member 1 (i.e., the "minimum value of the distance" is less than 0.1 times the "thickness of the object") are not preferable because a liquid is held between these anti-drop sites 3 and the sheet member 1 due to capillary force to cause mixing of a liquid between the adjacent holes 2.

Accordingly, these anti-drop sites 3 can be made of a hydrophobic material to prevent the mixing of a liquid between the adjacent holes 2. Specific examples thereof include plastic resins such as polystyrene and nylon. Even a hydrophilic material may be used for the anti-drop sites of the present invention by making the material hydrophobic by processing.

A plurality of anti-drop sites 3 is provided at intervals that agree with the intervals between the holes 2 provided in the sheet member 1. The anti-drop member 6 is disposed adjacently to one side of the sheet member 1 such that the anti-drop sites 3 are respectively disposed in the vicinity of one opening of their corresponding holes 2.

Specifically, in the object-holding sheet having the linear anti-drop sites 3, at least one line as the anti-drop site 3 can be disposed in the vicinity of one opening of each hole 2. Alternatively, in the object-holding sheet having the mesh-like anti-drop sites 3, at least one intersection can be disposed in the vicinity of one opening of each hole 2. Alternatively, in the object-holding sheet having the pin-like anti-drop sites 3, at least one pin-like anti-drop site 3 can be disposed in the vicinity of one opening of each hole 2.

The sheet member 1 and the anti-drop member 6 can respectively be provided with predetermined sites such that the sheet member 1 and the anti-drop member 6 are adjacent to each other at relative positions to correspondingly dispose a plurality of holes 2 and a plurality of anti-drop sites 3. For example, one of the sheet member 1 and the anti-drop member 6 can be provided with projections, and the other member is provided with depressions. As a result, the projections can be fitted in the depressions to specify the relative positions.

The sheet member 1 may have a nonconductive surface, and one of the inner wall of each hole 2 and each anti-drop site 3, or both, may be rendered conductive for individual conduction with the outside. As a result, one of the hole 2 and the anti-drop site 3 can be used as a work electrode, and the other region can be used as a counter electrode. This enables the electric property of the liquid held in each hole 2 to be measured or enables the electrochemical reaction thereof to be measured or induced.

When the inner wall of each hole 2 is rendered conductive, the conduction of the conductive inner wall with the outside may be achieved, for example, by carrying out wiring on the surface of the sheet member 1 using conductive ink. An insulating film can further be provided on the wiring to protect the wiring from a short circuit associated with liquid holding. The conductive site in the inner wall of each hole 2 can be divided into two parts, or each anti-drop site 3 can be rendered conductive. As a result, one of these two parts or one of the hole 2 and the anti-drop site 3 can be used as a work electrode, and the other region can be used as a counter electrode.

When the mesh-like anti-drop sites 3 are rendered conductive, the longitudinal and lateral anti-drop sites constituting the mesh can be kept from coming in contact with each other. As a result, one of the longitudinal and lateral anti-drop sites can be used as a work electrode, and the other site can be used as a counter electrode. The distance between the longitudinal and lateral anti-drop sites is set to within a range that permits the lower anti-drop site in the direction of gravitational force to come in contact with the held liquid.

When the linear or mesh-like anti-drop sites 3 are rendered conductive, a portion hidden by the sheet member 1 can be made hydrophobic by processing.

Hereinafter, a method for holding the objects, a method for administering a predetermined substance to the objects, a test method for the objects, and a liquid exchange method will be described, which use the object-holding sheet of the present invention having the irremovable anti-drop member (first embodiment) or the object-holding sheet of the present invention having the removable anti-drop member (second embodiment). These methods described herein are adapted to both the object-holding sheets, unless otherwise specified.

One embodiment of the method for holding the objects according to the present invention is a method which includes bringing the objects dispersed in a liquid into contact with the object-holding sheet to arrange only one of the objects in each hole 2 together with the liquid such that the object is held in the hole 2. The liquid containing the objects is brought into contact with the object-holding sheet by a method including, but not particularly limited to, a method which includes pouring the object-containing liquid to the object-holding sheet from above and a method which includes dipping the object-holding sheet into the object-containing liquid. These methods may be used alone or in combination.

Examples of the object-containing liquid include a suspension containing a large number of fish eggs suspended in water. A slit-type coater known in the art may be used as one method which includes pouring the object-containing liquid thereto from above. In such a case, the object-containing liquid can be placed uniformly all over the surface of the object-holding sheet from the slit die. An excess liquid, if any, connecting liquids in a plurality of holes 2 tends to cause contamination between the holes and tends to cause the object to be held in a site other than the hole 2. Therefore, as few droplets as possible can be allowed to remain in the site other than the hole 2.

Thus, an excess of the object-containing liquid after the contact can be eliminated easily by tilting the object-holding sheet, wiping the liquid off the back thereof using a blade, or blowing air thereon. However, when air is blown thereon, the air pressure or angle of blowing must be controlled so as not to blow off the object held in each hole 2. In such a case, the object-holding sheet can have a hydrophobic surface. Owing to the hydrophobic surface, an excess of the liquid can be removed easily because the region other than the hole 2 is repellent to aqueous liquids. In this case, the hydrophobic surface may have a contact angle of approximately 90 degree or larger relative to the liquid.

For holding the object by the surface tension of the object-containing liquid in each hole 2 in the object-holding sheet, the liquid can have a surface tension of approximately 25 mN/m or more. A liquid having a surface tension less than 25 mN/m may hardly permit the object to be held in each hole 2 together therewith and often cause the object to drop off even by slight oscillation. The liquid held together with the object in the object-holding sheet can be an aqueous liquid that has high affinity for the object and easily adheres to the inner wall of the hole 2.

Examples of the aqueous liquid include water and water-soluble liquids (e.g., alcohol, glycol solvents and glycerin), and aqueous solutions containing these water-soluble liquids. When the aqueous solutions are used, these aqueous solutions can particularly contain 50% or more water. Furthermore, at least one agent can be selected from humectants, surface tension adjusters and thickeners and added thereto for the purpose of preventing vaporization of the object-holding liquid from the object-holding sheet or for the purpose of stabilizing the object holding.

Examples of the humectants include: polyhydric alcohols such as glycerin, propylene glycol, butylene glycol and sorbitol; mucopolysaccharides such as hyaluronic acid and chondroitin sulfate; and protein hydrolysates such as soluble collagen, elastin and keratin. These humectants can be used alone or as a mixture of some of them.

Examples of the surface tension adjusters include water-soluble anionic, cationic, amphoteric or nonionic surfactants. One or more of these surface tension adjusters can be added. However, the surface tension adjuster(s) are added in an amount that permits the liquid to have a surface tension of 25 mN/m or more.

Examples of the thickeners include water-soluble polymer compounds including: starches such as acid-modified starch, enzyme-modified starch, thermo-chemically modified starch, cationic starch, amphoteric starch and esterified starch; cellulose derivatives such as carboxymethylcellulose, hydroxyethylcellulose and ethylcellulose; natural or semisynthetic polymers such as casein, gelatin and soybean proteins; and polyvinyl alcohols such as completely or partially saponified polyvinyl alcohol, acetoacetylated polyvinyl alcohol, carboxy-modified polyvinyl alcohol, olefin-modified polyvinyl alcohol and silyl-modified polyvinyl alcohol. At least one water-soluble polymer compound can be selected appropriately from among these thickeners and used.

In the present invention, the liquid used can have a viscosity of 0.1 Pa·s (pascal second) or more. If necessary, the thickener(s) may be added thereto. The liquid may be controlled to have a salt concentration or pH suitable for the objects. In such a case, salts such as sodium chloride or various pH adjusters, or antiseptics or antimicrobial agents may be added appropriately thereto.

A test on correlation between a substance and the objects can be conducted by holding the objects in the object-holding sheet of the present invention and then administering the substance to each of the objects. Hereinafter, a test method will be described in detail, which includes administering the substance to the object held, together with the liquid, in each hole 2 in the object-holding sheet and examining its effect.

The test method of the present invention includes: allowing an object to be held, together with a liquid, in each of the through-holes 2 in the object-holding sheet of the present invention; administering a substance to the object; discharging an excess liquid from the opening on the side provided with the anti-drop member, while supplying a liquid from the other opening of the through-holes; and observing the state of the object held in each of the holes.

The test of the present invention refers to administering the substance to the objects held in the object-holding sheet and obtaining information about the correlation of reaction induced for the objects with the administered substance. Specifically, when the held objects are biological materials (e.g., cells, embryos or individuals), examples of the test include a growth test on a nutritional substance administered thereto, a carcinogenicity test on a chemical substance administered thereto, a teratogenicity or endocrine disruption test on a biologically active substance administered thereto, and a pharmacological activity test on a substance as a drug candidate administered thereto. Alternatively, when the held objects are particles, examples of the test include a test on whether particles carrying an antigen or antibody on their surfaces bind to an antibody or antigenic substance administered thereto and a test on whether particles carrying, on their surfaces, a nucleic acid having a sequence complementary to the sequence of a nucleic acid administered thereto hybridize to the nucleic acid.

Alternative examples of the test of the present invention include measurement of the electric property of the held liquid and measurement or induction of the electrochemical reaction thereof. Examples of the electric property of the liquid include electric conductivity, electric resistance and potential of the liquid. Examples of the electrochemical reaction of the liquid include oxidation-reduction reaction of dissolved oxygen, oxidation-reduction reaction of the administered substance, and changes in impedance.

The substance administered to the objects encompasses, but not limited to, organic or inorganic chemical substances, metals and compounds thereof, substances constituting living bodies, biologically active substances derived from living bodies, DNA, bacteria, viruses, and complexes with those chemical substances, and mixtures of a plurality of chemical substances. The administration of the substance can be performed by applying a droplet containing one or more of these substances to the holes 2 in the object-holding sheet.

In the present invention, the substance administered to the objects can be examined for the presence or absence of its effect. When the effect is present, changes in the effect caused by varying doses or time-dependent changes in the effect can be examined. The substance can be administered by a method which includes dissolving or dispersing the substance in a solvent such as water or an organic solvent and administering this liquid. Such a liquid can be discharged in a droplet form and administered directly onto the object held in each hole 2 in the object-holding sheet.

Examples of an equipment for preparing the liquid in a droplet form include micropipettes, microdispensers, and equipments which discharge droplets from a nozzle using an energy-generating device, i.e., discharge equipments using an inkjet method. The discharge equipments using an inkjet method can be used suitably in terms of microdroplets that can be discharged therefrom. Among inkjet methods, particularly, a thermal inkjet or piezoelectric inkjet method can be used.

In the present invention, microdroplets can be added in a dispersed state to the whole surface of the area of each hole to avoid localized administration to the objects. In this case, 100 or more drops can be administered in a dispersed state to one hole 2. This enables the substance to reproducibly act on the object in the area. Therefore, the liquid can be administered in a droplet form having a volume of 100 pl or smaller per drop.

In the test method of the present invention, the liquid accompanying the object or the substance can be exchanged, if necessary. By use of the object-holding sheet of the present invention, the liquid held in each hole 2 can be exchanged subsequent to the substance administration by discharging an excess liquid from the opening on the side provided with the anti-drop member, while supplying a liquid from the other opening of the holes 2. The object-holding sheet of the present invention includes the anti-drop member 6. Therefore, the object held, together with the liquid, in each hole 2 is prevented from dropping off even when a liquid is supplied from the other opening of the holes 2. The procedure of supplying the liquid can be performed by adding microdroplets using micropipettes, microdispensers, and equipmentes which discharge droplets from a nozzle using an energy-generating device, i.e., discharge equipmentes using an inkjet method, as in the substance administration.

The discharge of an excess liquid from the opening of the hole 2 on the side provided with the anti-drop member 6 can be performed by disposing a water-absorptive/permeable member 9 in the vicinity of the anti-drop sites on the side provided with the anti-drop member 6, as illustrated in (iii) of FIG. 2C. Specifically, the water-absorptive/permeable member 9 can absorb droplets dangling from the openings of the holes 2 according to the supply of the liquid. The water-absorptive/permeable member 9 may be made of, without limitations, any material that absorbs the liquid or is permeable to the liquid. Examples of the material can include: those absorbing water through a capillary phenomenon, such as cotton, pulp, paper, cloth, unwoven cloth and sponge; those absorbing water through an osmotic pressure, such as super absorbent resins; and silica sand, silica gel and porous membranes.

The droplets dangling from the openings of the holes 2 according to the supply of the liquid are quickly absorbed upon contact with the water-absorptive/permeable member 9 disposed in the vicinity of the anti-drop member 6. At the same time, the liquid held in each hole 2 is decreased. However, owing to the adhesion of the liquid to the hole 2, not the whole liquid held in the hole 2 is absorbed. Therefore, the liquid held in the hole 2 can be exchanged by subsequently performing the procedure of supplying the liquid.

As shown in the first and second embodiments of the present invention, the anti-drop member 6 may be formed integrally with the sheet member 1 or may be removable from the sheet member 1. Owing to this removability, the object held, together with the liquid, in each hole 2 can be observed easily, while the held object can be collected from the mouse on the side provided with the anti-drop member 6.

When the held object is observed or collected, the anti-drop member 6 may be removed from the sheet member 1 or a plurality of anti-drop sites 3 provided in the anti-drop member 6 may respectively be shifted only by half the period of a plurality of holes 2 provided in the sheet member 1. For allowing the anti-drop member 6 to be shifted only by half the period, the lengths of the depressions provided in one of the sheet member 1 and the anti-drop member 6 fitted in each other can be increased at least by half the period.

The present invention also provides an object-treatment equipment for treating the held objects using the object-holding sheet of the present invention.

The object-treating equipment of the present invention includes a holding unit which holds the object-holding sheet; an applying unit for applying a droplet to the holes 2 in the object-holding sheet; and a discharging unit which discharges an excess liquid from the opening on the side provided with the anti-drop member, wherein the treatment equipment further includes at least one of the following units (A) to (E): (A) an arranging unit for arranging an object to each of the holes 2 in the sheet member 1; (B) a controlling unit for controlling an environment surrounding the object-holding sheet to a predetermined environment; (C) an observing unit for observing the state of the object held in each of the holes 2 in the object-holding sheet; (D) a transporting unit for transporting, from the object-holding sheet, the object held in each of the holes 2 in the object-holding sheet; and (E) a recognizing unit for recognizing the positions of the holes 2 in the object-holding sheet.

The object-treating equipment of the present invention can also be provided with an electric circuit for applying an electric signal to each work electrode and counter electrode in the object-holding sheet or obtaining a response signal such as electric current or voltage. This enables the electric property of the held liquid to be measured or enables the electrochemical reaction thereof to be measured or induced.

Figure 6:
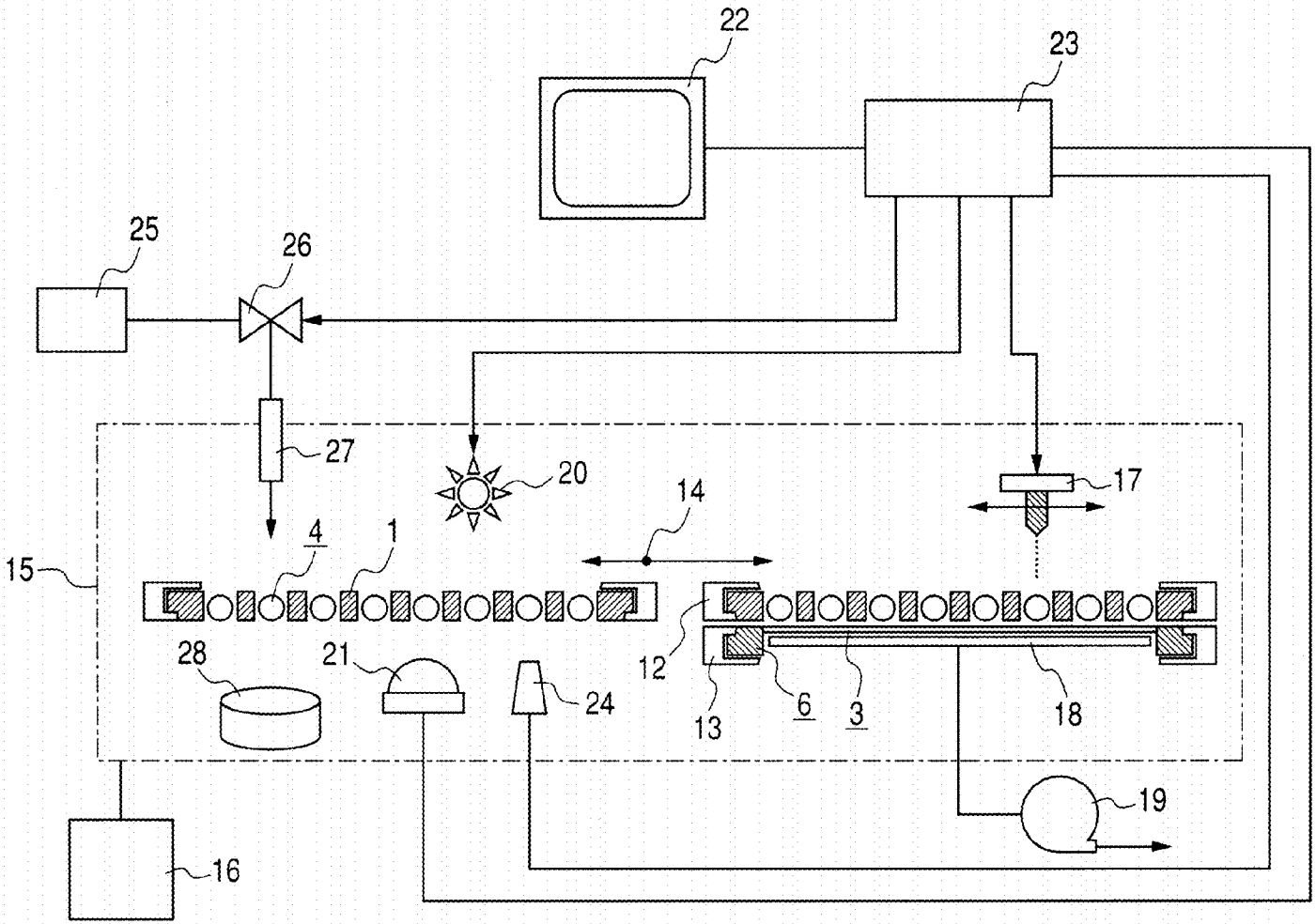
FIG. 6 is a schematic view of the system configuration of a treatment equipment used in Example.

Hereinafter, the object-treating equipment of the present invention will be described with reference to an example of the configuration thereof (FIG. 6). However, this is an example of the object-treating equipment of the present invention, and the present invention is not limited thereto.

Objects are arranged by the arranging unit (A) in the sheet member 1 in the object-holding sheet of the present invention, and this sheet member 1 is secured in a movable sheet member holder 12. On the other hand, the anti-drop member 6 is secured in a movable anti-drop member holder 13. The movable sheet member holder 12 can move the sheet member 1 in the object-holding sheet in the two axial directions of X and Y axes. The movable anti-drop member holder 13 can move the anti-drop member only in a Y direction.

In this context, the Y direction represents a direction perpendicular (vertical direction on paper surface) to an X direction 14 in FIG. 6. The object-holding sheet is surrounded by a chamber 15 to allow the object-holding sheet to be always kept in a constant environment. The internal temperature and humidity of the chamber 15 are controlled by a temperature-humidity controlling equipment 16 (controlling unit (B)). Specifically, the temperature and the relative humidity are kept between 25° C. and 40° C. and between 60% and 90%, respectively, to prevent vaporization of moisture of the objects.

Moreover, an inkjet equipment 17 that is movable in one axial direction (X axis) is provided above the openings of the holes 2 such that the predetermined substance can be added to the objects. On the other hand, a liquid waste recovery portion 18 is provided under the openings of the holes 2 such that an excess liquid can be discharged (absorbed).

Specifically, while water is added dropwise from the inkjet equipment 17, excess water dangling from the openings of the holes 2 in the sheet member 1 is absorbed by the liquid waste recovery portion 18 (discharging unit) and aspirated by a liquid waste delivery equipment (pump) 19 for discharge. In this way, the liquid contained in each hole 2 can be exchanged, and the handled object can be washed.

The objects to be handled are observed by irradiating the objects held in the sheet member 1 with a visible light (white light at a wavelength of 300 to 900 nm) from a lighting portion 20, while taking a bright-field image by a CCD camera 21 (observing unit (C)) provided below the sheet member 1. The taken image is confirmed in a monitor 22 and stored in a control portion 23. The control portion 23 receives positional information from a sensor portion 24 (recognizing unit (E)) that recognizes the positions of the holes 2 in the object-holding sheet of the present invention and controls the positions of the holes 2 in the sheet member 1 via the movable sheet member holder 12 and the positions of the anti-drop sites in the anti-drop member 6 via the movable anti-drop member holder 13.

To objects that are completely handled or unhandled (e.g., controls), air can be injected using a gas injection nozzle 27 (transporting unit (D)) through a magnetic valve 26 from a compressed air supply equipment 25 to drop the individual objects to a recovery container 28 provided therebelow.

EXAMPLE 1

Object-Holding Sheet Having Linear Anti-Drop Sites

Figure 3:
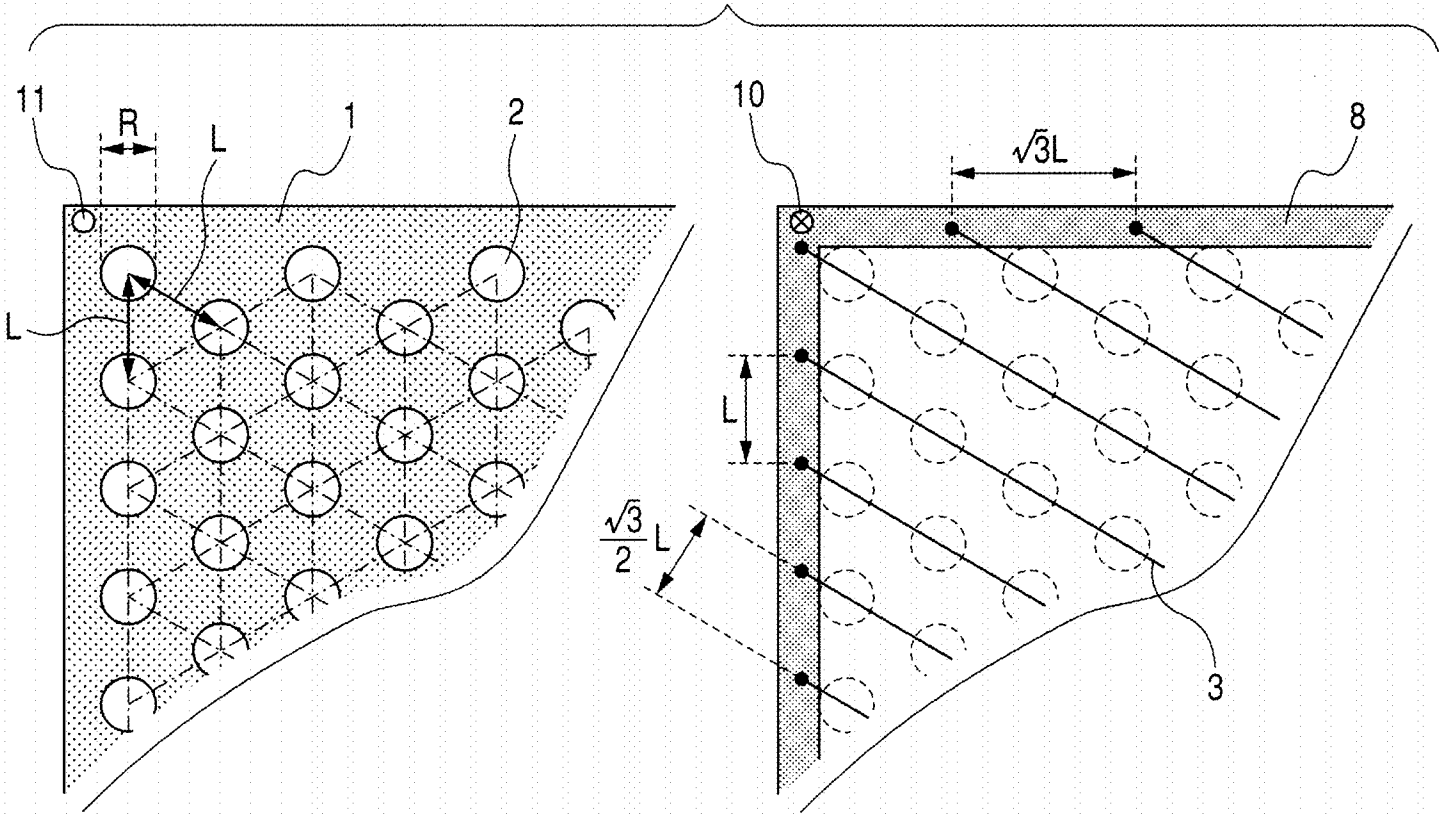
FIG. 3 is a plane view of a sheet member and an anti-drop member in an object-holding sheet illustrated in Example.

A 100 mm square stainless sheet having a thickness of 0.9 mm was processed to prepare a sheet member 1 having the following specifications for an object-holding sheet. Holes 2 are round in shape as illustrated in FIG. 3 and uniformly spaced to form 2236 holes in a close-packed manner with a hole diameter R=1.2 mm and a distance L=2.25 mm between the holes. The diagram also illustrates an indexing projection member 10 and an indexing hole 11.

A 100 mm square stainless sheet having a thickness of 0.9 mm was processed to prepare an anti-drop member 6 having the following specifications for the object-holding sheet.

A 92 mm square quadrangle was cut out of the sheet with an 8.0-mm width of the marginal area left to prepare a frame member. Equally spaced 0.3 mm holes were formed in the frame. The intervals between the holes in the longitudinal direction were set to 2.25 mm, which was equal to the intervals between the holes in the sheet member. The intervals between the holes in the lateral direction were set to 3.89 mm ($=L\times\sqrt{3}$). Each silk gut of 0.2 mm in diameter was diagonally placed to connect the longitudinally formed hole to the laterally formed holes in the frame member. The intervals between the silk guts were set to 1.94 mm, which was $L\times(\sqrt{3})/2$.

Four corners of the anti-drop member and the sheet member were provided with protrusions and depressions for determining their relative positions. These protrusions were fitted in the depressions to build an object-holding sheet. The silk guts placed in the anti-drop member were arranged directly below the through-holes in the sheet member and kept from coming in contact with the sheet via spacers that were round flat washers of 0.3 mm in thickness in which the protrusions provided in the anti-drop member were inserted.

100 ml of a water suspension of *Danio rerio* fertilized egg having an average diameter of approximately 1 mm (20 cells/ml) was poured to the object-holding sheet from above to cause contact therebetween. Then, by removal of an excess liquid from the sheet, the fertilized egg was held in each hole in the sheet, together with the liquid present in the hole. An excess liquid on the object-holding sheet was discarded by tilting the sheet so as not to leave a water droplet in sites other than the opening.

Figure 4:
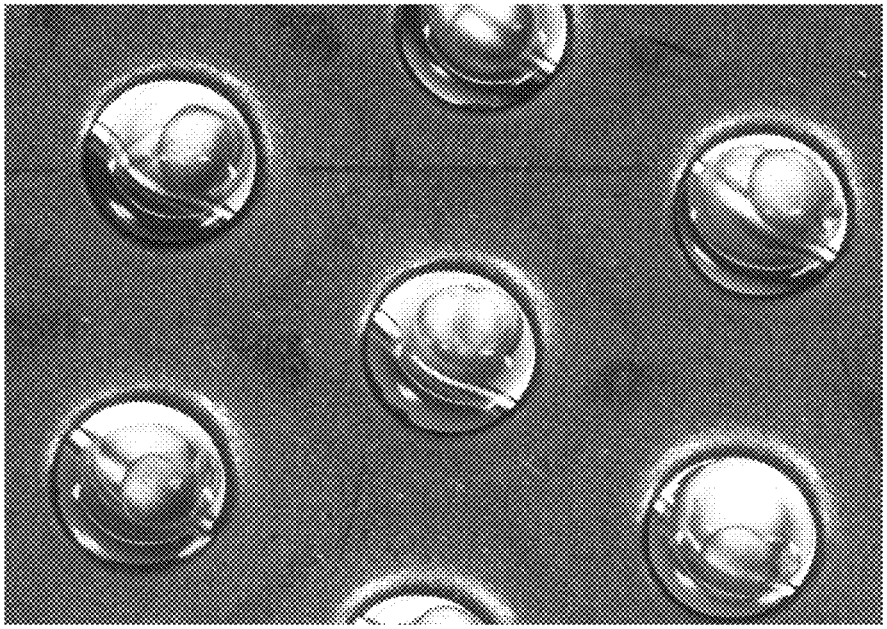
FIG. 4 is an image of fertilized eggs taken in Example.

Each opening (hole) in the thus-obtained object-holding sheet with the fertilized eggs arranged therein was observed under a stereoscopic microscope to observe the state of the fertilized egg held in each hole. As illustrated in FIG. 4, the fertilized eggs could be observed clearly.

A filter paper cut into 90 mm square was put on the silk guts from under the anti-drop member. While distilled water was added dropwise from the openings in the object-holding sheet using a micropipette, the liquid was absorbed into the filter paper. The fertilized eggs were confirmed not to drop off during the course of dropwise addition of distilled water.

A water suspension of fertilized eggs was stained by addition of toluidine blue and then held in the object-holding sheet in the same way as above. Liquid exchange was performed in the same way as above by adding dropwise distilled water using a micropipette and allowing the liquid to be absorbed into the filter paper. The liquid held in the object-holding sheet was collected and measured for its absorbance to calculate a residual rate of toluidine blue. As a result, the residual rate was 5% or less.

EXAMPLE 2

Object-Holding Sheet Having Pin-Like Anti-Drop Sites

Toothpicks of 2.25 mm in diameter (manufactured by MARUKI) were used as pin-like anti-drop sites and bundled in a close-packed manner to prepare a pin-like anti-drop member. The tip of each toothpick agrees with the pitch between the holes 2 in the sheet member 1 prepared in Example 1. Therefore, both the members could be held with a stand so as to correspondingly dispose a plurality of the pin-like anti-drop sites (tips of the toothpicks) in the anti-drop member, in the vicinity of the holes 2 in the sheet member 1.

In the same way as in Example 1, a suspension of *Danio rerio* fertilized eggs was brought into contact with the object-holding sheet, and the fertilized egg was held in each hole 2 in the sheet. An excess liquid on the object-holding sheet was discarded using a silicon rubber spatula so as not to leave a water droplet in sites other than the opening.

Figure 5:
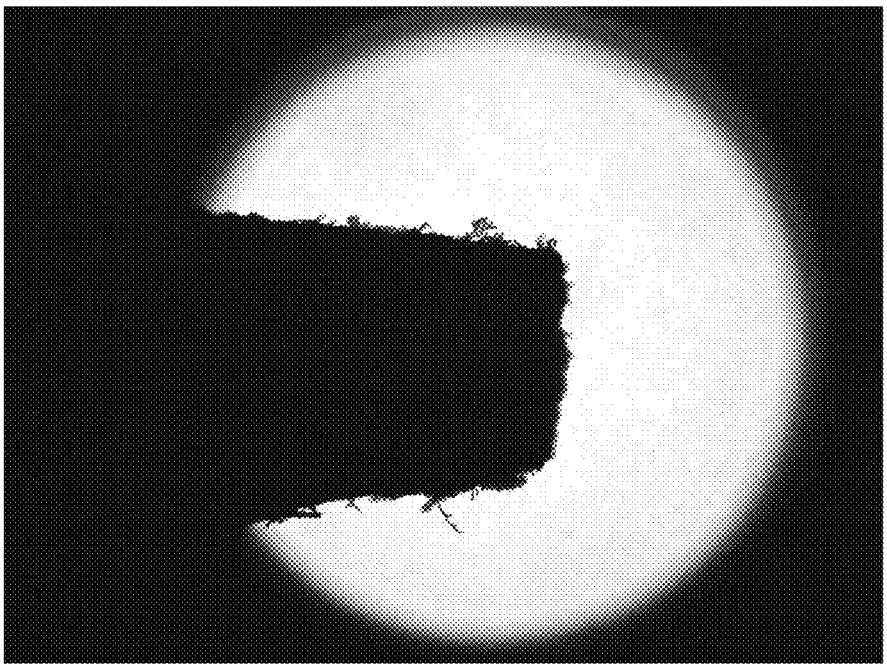
FIG. 5 is an image of a pin-like anti-drop site taken in Example.

The state of each fertilized egg held therein was observed under a stereoscopic microscope (manufactured by Leica Microsystems, S8 APO). The fertilized eggs were observed to neither drop off nor be crushed. FIG. 5 illustrates an enlarged view of the observed tip of the toothpick together with one hole 2 (hole diameter: 1.2 mm). In contrast to the bright circular hole 2, the tip of the toothpick is indicated as a shadow. The tip of the toothpick was flat and was thus presumed not to cause damage on the fertilized egg.

An attempt was made to exchange the liquid in each hole 2 in the same way as in Example 1, while distilled water was added dropwise using a micropipette. When distilled water was added dropwise in the dry state of the toothpicks, the liquid was swollen above the level of the hole 2 in the sheet member 1 and did not flow downward. Thus, liquid exchange was achieved by aspirating the swollen droplet using a micropipette again.

Next, the pin-like anti-drop member was dipped in distilled water. In this wet state of the toothpicks, the same dropwise addition experiment was conducted. Distilled water added dropwise using a micropipette was swollen above the level of the hole 2, and this swollen droplet was found to slide down the wet toothpick. The discharge rate of distilled water was found to increase owing to water absorption into a filter paper brought into contact with the back of the anti-drop member 6. Capillary force between the bundled toothpicks presumably contributes to this effect.

At the point in time when the discharge of distilled water swollen above the level of the hole 2 proceeded to decrease the capacity of the held liquid, the sheet member 1 was removed by lifting from the anti-drop member. As a result, the fertilized eggs were observed not to drop off. This is presumably because the adhesion of the liquid held in each hole 2, to the inner wall of the hole 2 is relatively larger than its adhesion to the anti-drop site 3. Therefore, when the held liquid is split according to the ratio between these adhesions, the fertilized egg may not be contained in the liquid split by attaching to the anti-drop site.

EXAMPLE 3

Object-Treating Equipment

FIG. 6 illustrates an example of the system configuration of an equipment for treating objects using the object-holding sheet of the present invention. Next, an example of the operation of this equipment will be described.

The sheet member 1 in the object-holding sheet in which 20 *Danio rerio* fertilized eggs were held was secured in a movable sheet member holder 12. On the other hand, the anti-drop member 6 was secured in a movable anti-drop member holder 13. The movable sheet member holder 12 can move the sheet member 1 in the object-holding sheet in the two axial directions of X and Y axes. The movable anti-drop member holder 13 can move the anti-drop member only in a Y direction.

In this context, the Y direction represents a direction perpendicular (vertical direction on paper surface) to an X direction 14 in FIG. 6. The object-holding sheet is surrounded by a chamber 15 to allow the object-holding sheet to be always kept in a constant environment. In this Example, the object-holding sheet is kept in an environment that involves a temperature and relative humidity (RH) controlled to 28° C. and 85%, respectively, and allows the fertilized eggs to grow while preventing vaporization of moisture. An inkjet equipment 17 that is movable in one axial direction (X axis) and discharges 8 pl of a droplet is provided therein as a unit which allows a chemical substance to act on the fertilized eggs. In this Example, a droplet of a cycloheximide solution (10 mg/ml) was applied in each predetermined amount (a total of 0.8 mL, 8 mL, 80 mL or 800 mL) to 3 fertilized eggs (a total of 12 fertilized eggs). A total of 15 fertilized eggs including 3 fertilized eggs to which no cycloheximide solution was applied as a blank were allowed to grow.

Ten minutes after the action of the cycloheximide solution on the fertilized eggs, liquid exchange (washing) was performed. Water was added dropwise to the object-holding sheet using the inkjet equipment 17. A liquid waste recovery portion 18 including a porous cellulose membrane is disposed adjacent to the anti-drop sites 3. With progress in water supply by dropwise addition, liquids dangling from the openings in the sheet member are quickly absorbed upon contact with the porous membrane and further aspirated by a liquid waste delivery equipment (pump) 19 for discharge. By these procedures, the liquid exchange (washing) was achieved.

The fertilized eggs were observed by irradiating the fertilized eggs held in the sheet member 1 with a visible light (white light at a wavelength of 300 to 900 nm) from a lighting portion 20, while taking a bright-field image by a CCD camera 21 (observing unit (C)) provided below the sheet member 1. A fluorescence image was also taken by the CCD camera with the fertilized eggs irradiated with an excitation light at a wavelength of 480 to 490 nm diffracted from the lighting portion 20. Acridine orange (5 mg/mL) was applied thereto in a total amount of 1 mL for staining using the inkjet equipment 17 again in a time-dependent manner (i.e., 2 hours, 4 hours, 8 hours, and 16 hours later) after the chemical substance administration. The sheet was further left standing for 30 minutes, and visible and fluorescence images were then taken. The taken images are confirmed in a monitor 22 and stored in a control portion 23. The control portion 23 receives positional information from a sensor portion 24 (recognizing unit (E)) that recognizes the positions of the holes in the object-holding sheet and controls the positions of the holes in the sheet member via the movable sheet member holder 12 and the positions of the anti-drop sites in the anti-drop member via the movable anti-drop member holder 13.

16 hours later, to the fertilized eggs on which the chemical substance was or was not allowed to act, air can be injected using a gas injection nozzle 27 (transporting unit (D)) through a magnetic valve 26 from a compressed air supply equipment 25 to individually drop the fertilized eggs to a recovery container 28 provided therebelow. In the container, which contained water, the fertilized eggs were hatched 2 days later, and larva was further allowed to grow.

EXAMPLE 4

Object-Holding Sheet Having Mesh-Like Anti-Drop Sites

Figure 7:
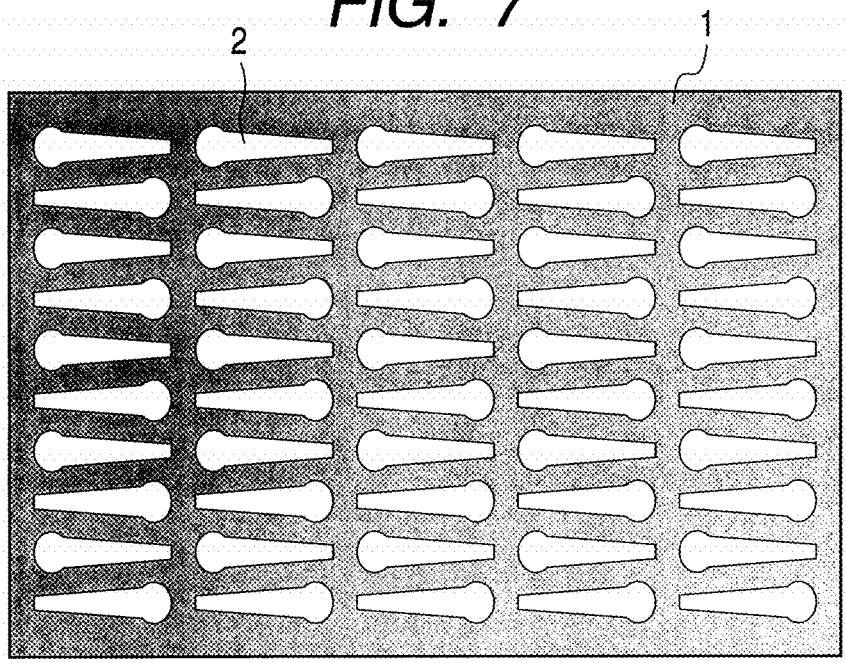
FIG. 7 is a plane view of a sheet member in an object-holding sheet used in Example.
Figure 8:
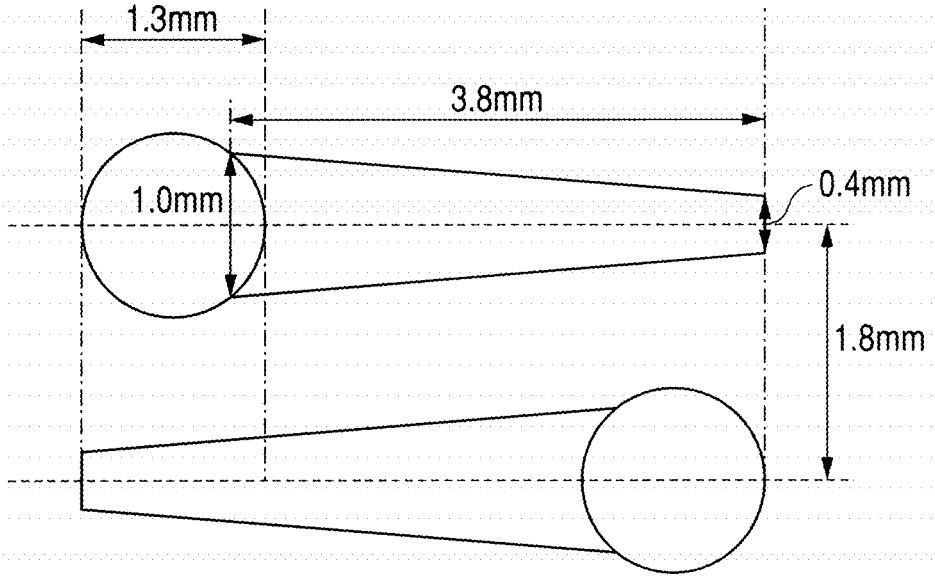
FIG. 8 is a two-dimensional view of a portion of a sheet member in an object-holding sheet used in Example.

A 100 mm×150 mm Teflon (registered trademark) sheet having a thickness of 0.7 mm was processed by blanking into a shape similar to the outline of larva, as illustrated in FIG. 7, to prepare a sheet member 1. FIG. 8 is enlarged view illustrating the dimension of the opening.

A polypropylene mesh (aperture: 376 μm, line diameter: 153 μm, aperture rate: 50%, thickness: 285 μm) was cut into a size of 100 mm×150 mm. A 92 mm×142 mm quadrangle was cut out of a 100 mm×150 mm stainless sheet having a thickness of 0.9 mm, with an 8.0-mm width of the marginal area left, to prepare a frame member. The polypropylene mesh was affixed to this frame member to prepare an anti-drop member 6.

The sheet member 1 and the anti-drop member 6 were disposed such that these members faced each other via a 0.3-mm spacer to prepare an object-holding sheet.

To 50 ml of a suspension of *Danio rerio* fertilized eggs (20 eggs/ml) immediately after egg recovery, 0.03 wt % methylcellulose was added as a thickener. Instant Ocean (final concentration: 60 μg/mL) manufactured by Aquarium Systems was dissolved in distilled water and used in the suspension. Penicillin (5 units/mL) and streptomycin (5 μg/mL) were further added thereto as antimicrobial agents. The suspension of the fertilized eggs was poured to the object-holding sheet from above. Then, an excess liquid was then removed from the object-holding sheet. The fertilized egg was held in each hole, together with the liquid present in the hole, in the fertilized egg-holding area in the object-holding sheet. An excess liquid on the biological material (object)-holding sheet was discarded by tilting the object-holding sheet so as not to leave a water droplet in sites other than the opening.

The object-holding sheet with the fertilized eggs held therein was mounted to the treatment equipment described in Example 3 and left as it was to hatch the fertilized eggs. During this process, water was appropriately discharged from the inkjet equipment for the purpose of compensating for water vaporization from the holes. While water was supplied from the inkjet equipment, excess water was absorbed for discharge by pressing absorbent cotton to the mesh from under the mesh. In this way, liquid exchange was achieved. Three days after hatching, bright-field observation was performed to confirm that juvenile zebrafish was alive. In the object-holding sheet, the fertilized eggs thus arranged were successfully grown and hatched, and the resulting juvenile zebrafish was successfully grown for 5 days or more after hatching with it disposed in the sheet. During the course of this process, the fry was observed not to drop off.

EXAMPLE 5

Integral-Type Object-Holding Sheet Having Irremovable Anti-Drop Member

Figure 9:
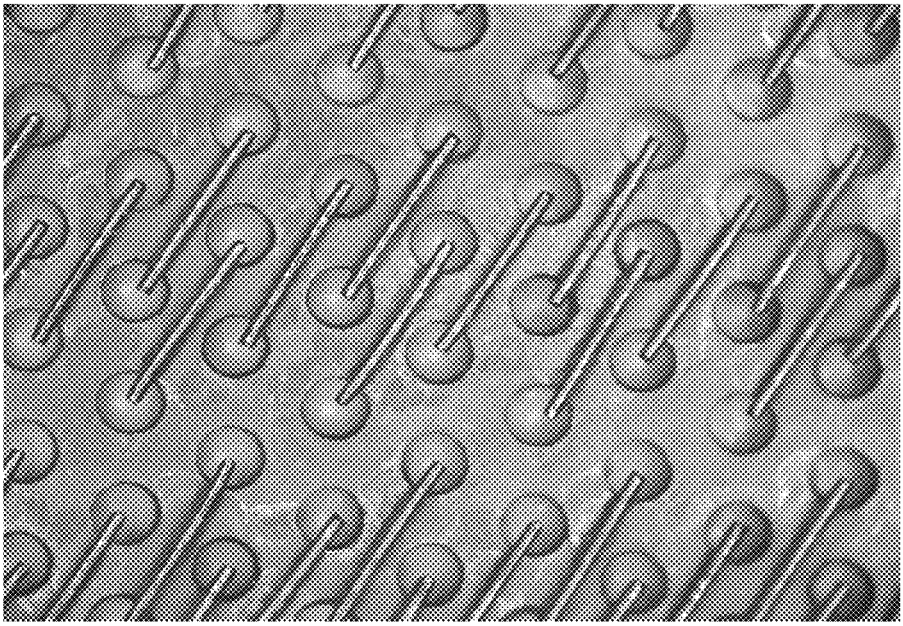
FIG. 9 is an image of an object-holding sheet taken in Example.

A stainless wire of 0.2 mm in diameter was cut into a length of 3.89 mm and bonded in the vicinity of one opening of the holes provided in the sheet member prepared in Example 1 to prepare anti-drop sites having the following specifications. Specifically, as illustrated in FIG. 9, the cut stainless wires were bonded thereto in the same directions such that both ends each wire were respectively placed across only half the hole. Aron Alpha (manufactured by TOAGOSEI CO., LTD., registered trademark) was used in the bonding.

Figure 10:
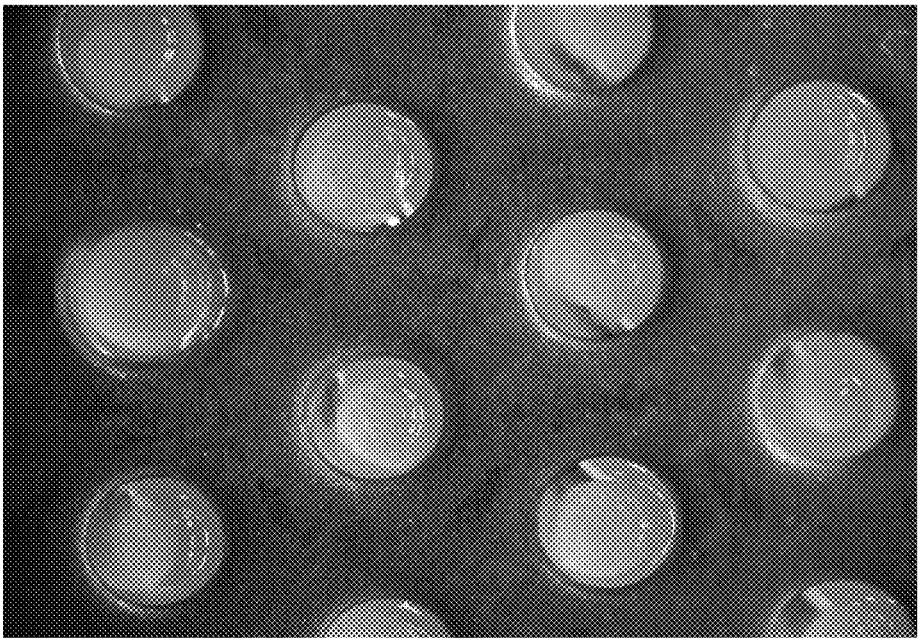
FIG. 10 is an image of fertilized eggs taken in Examples.

In the same way as in Example 1, a water suspension of *Danio rerio* fertilized eggs was poured to the object-holding sheet from above to cause contact therebetween, and then, by removal of an excess liquid from the sheet, the fertilized egg was held in each hole in the sheet, together with the liquid present in the hole. As illustrated in FIG. 10, the *Danio rerio* fertilized egg could be held in each hole together with the liquid.

A filter paper cut into 90 mm square was put on the anti-drop member from under the anti-drop member. While distilled water was added dropwise from the openings in the object-holding sheet using a micropipette, the liquid was absorbed into the filter paper. The fertilized eggs were confirmed not to drop off during the course of dropwise addition of distilled water.

A water suspension of fertilized eggs was stained by addition of toluidine blue and then held in the object-holding sheet in the same way as above. Liquid exchange was performed in the same way as above by adding dropwise distilled water using a micropipette and allowing the liquid to be absorbed into the filter paper. The liquid held in the object-holding sheet was collected and measured for its absorbance to calculate a residual rate of toluidine blue. As a result, the residual rate was 5% or less.

The object-holding sheet of the present invention is used as a useful tool in, for example, a growth test on a nutritional substance administered to biological materials (e.g., cells, embryos or individuals), a carcinogenicity test on a chemical substance administered thereto, a teratogenicity or endocrine disruption test on a biologically active substance administered thereto, and a pharmacological activity test on a substance as a drug candidate administered thereto.

The present invention is not limited to the above embodiments and various changes and modifications can be made within the spirit and scope of the present invention. Therefore to apprise the public of the scope of the present invention, the following claims are made.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-131621, filed May 29, 2009, which is hereby incorporated by reference herein in its entirety.

What is claimed is:

1. An object-holding sheet for holding two or more objects, the object-holding sheet comprising:

a sheet member having two or more through-holes, each hole having a corresponding anti-drop member;

wherein each hole has a sidewall, a top opening on one side and a bottom opening on the other side;

wherein the sheet member has a thickness in the vicinity of each hole of from 0.2 μm to 10 mm, and wherein each anti-drop member is positioned with respect to the bottom opening of each hole such that a main portion of the object is held at a position located in the hole between the top and bottom openings of each hole formed in the sheet member, and is not permitted to pass through the bottom opening in the sheet member, wherein each anti-drop member consists essentially of a wire member that is attached to the edge of the bottom opening of the corresponding hole, and wherein the wire member extends across the bottom opening of the hole through at least the center of the bottom opening.

2. The object-holding sheet according to claim 1, wherein the anti-drop member is set on a removable frame member.

3. The object-holding sheet according to claim 1, wherein the holes are defined by a top opening on one side of the sheet member and a bottom opening on the other side of the sheet member, and have a diameter in the range from 1.05 μm to 26.3 mm through from the top opening on one side to the bottom opening on the other side.

4. A treatment equipment for treating objects, the equipment comprising:

a holding unit which holds an object-holding sheet according to claim 1;

an applying unit for applying a droplet to the holes in the object-holding sheet; and a discharging unit which discharges an excess liquid from the opening on the side provided with the anti-drop member, wherein the treatment equipment further comprises at least one of the following units (A) to (E):

(A) an arranging unit for arranging an object to each of the holes in the sheet member;

(B) a controlling unit for controlling an environment surrounding the object-holding sheet to a predetermined environment;

(C) an observing unit for observing the state of the object held in each of the holes in the object-holding sheet;

(D) a transporting unit for transporting, from the object-holding sheet, the object held in each of the holes in the object-holding sheet; and (E) a recognizing unit for recognizing the positions of the holes in the object-holding sheet.

5. An object-holding sheet for holding two or more objects, the object-holding sheet comprising:

a sheet member having two or more through-holes, each hole having a corresponding anti-drop member; and wherein each hole has a sidewall, a top opening on one side and a bottom opening on the other side, wherein each anti-drop member is a linear member, and each linear member is disposed parallel to the sheet plane with respect to a hole corresponding thereto such that a portion thereof extends to and partially occupies a central part of an opening of the hole, wherein each anti-drop member is positioned with respect to the bottom opening of each hole such that a main portion of the object is held at a position located within the hole between the top and bottom openings of each hole formed in sheet member, and the object is not permitted to pass through the bottom opening in the sheet member, wherein each anti-drop member consists essentially of a wire member that is attached to the edge of the bottom opening of the corresponding hole, and wherein the wire member extends across the bottom opening of the hole through at least the center of the bottom opening.

* * * * *